US005401976A

United States Patent [19]

Bannasch

[11] Patent Number: 5,401,976

[45] Date of Patent: Mar. 28, 1995

[54] PROCESS TO CAMOUFLAGE HEAT EMITTING DEVICE AND PARTICLE FOR PROCESS

[75] Inventor: Heinz Bannasch, Schönau, Germany

[73] Assignee: Buck Werke GmbH & Co., Bad Uberkingen, Germany

[21] Appl. No.: 121,197

[22] Filed: Sep. 15, 1993

[30] Foreign Application Priority Data

Sep. 15, 1992 [DE] Germany ..... 42 30 826.7

[51] Int. Cl.[6] ..... G01J 5/06

[52] U.S. Cl. ..... 250/495.1; 250/342

[58] Field of Search ..... 250/339, 340, 342, 495.1

[56] References Cited

U.S. PATENT DOCUMENTS

| | | | |
|---|---|---|---|
| 3,444,380 | 5/1969 | Webb | 250/342 |
| 3,975,292 | 8/1976 | Shaffer | 250/342 |
| 4,112,300 | 9/1978 | Hall, Jr. et al. | 250/342 |
| 4,210,555 | 7/1980 | Lübbers et al. | 252/305 |
| 4,698,108 | 10/1987 | Véga et al. | 149/21 |
| 5,093,574 | 3/1992 | Pratt et al. | 250/339 |

FOREIGN PATENT DOCUMENTS

| | | |
|---|---|---|
| 3012405 | 10/1981 | Germany . |
| 3147850 | 6/1983 | Germany . |

*Primary Examiner*—Jack I. Berman
*Assistant Examiner*—James Beyer
*Attorney, Agent, or Firm*—Watson, Cole, Grindle & Watson

[57] ABSTRACT

A process to camouflage a device which emits infrared radiation from another device includes forming a wall of particles having a known distribution density between the two devices. The particles emit or absorb infrared radiation from a known surface area. The distribution density, surface area and distances between each device and the wall are such that the wall masks the device to be camouflaged yet does not mask the other device.

12 Claims, 3 Drawing Sheets

PROCESS TO CAMOUFLAGE HEAT EMITTING DEVICE AND PARTICLE FOR PROCESS

FIELD OF THE INVENTION

The invention relates to a camouflage process to protect a military object, equipped with a heat imaging device, preferably a tank, against an enemy miliary object, also equipped with a heat imaging device, preferably a tank. The process utilizes a camouflage wall made of particles, which emit or absorb infrared rays. The wall is produced by the object to be protected, and in particular at a distance from the object to be protected. The distance is preferably at least one power of ten shorter than the distance from the wall to the enemy object. The invention further relates to camouflage particles to implement such a process.

BACKGROUND OF THE INVENTION

Artificial smoke represents an important measure for camouflaging military targets. However, the recent successful realization and use of powerful heat imaging devices, for example, in tanks, has resulted in the artificial smoke no longer guaranteeing an adequate camouflage effect. Therefore, new camouflage smoke was developed that is also effective in the infrared spectrum. Thus, the publication DE 31 47 850 discloses a wide band camouflage smoke, which consists of powdery or droplet shaped smoke particles that absorb in the visible and infrared spectral range. Furthermore, a camouflage smoke is known from the publication DE 30 12 405 A1 which contains red phosphorous particles that are burned off and thus emit high infrared radiation that masks the heat image of the object to be protected from the heat imaging device of the attacking object.

One common drawback of this known infrared camouflage smoke, whether it exhibits particles emitting or absorbing infrared rays, is that due to the camouflage smoke that is employed not only the visibility of the attacker but also the visibility of the device generating the camouflage smoke is reduced, at least to the same degree. FIG. 1 shows such a typical situation. A denotes an attacking tank. At this stage it is to be assumed that the gunnar of tank A has detected tank B at a typical distance of 2,000 meters with his heat imaging device and initiated measure to combat it. To avoid this threat, the crew of tank B shoots in the near range an infrared effective smoke. Tank B produces a camouflage wall at a distance of, for example, 50 m with particles absorbing or emitting infrared radiation. Thus, the infrared signature of tank B can no longer be detected on the heat imaging device of tank A, but the visibility of tank B is thus reduced to the same degree. More specifically, on the heat imaging device of tank B the infrared signature of the attacking tank A can no longer be seen. Altogether the negative effect on the two tanks is even greater for tank B on account of the viewing angle covered by the camouflage wall. In the drawing the viewing angle of the heat imaging device of A is denoted as $\alpha$, whereas that of the heat imaging device of tank B is denoted as $\beta$.

SUMMARY OF THE INVENTION

It is an object of the present invention to improve infrared camouflage processes and the particles serving to construct an infrared camouflage wall while maintaining an adequate camouflage effect. The present invention enables one's own heat imaging device to be only insignificantly disturbed. In other words, a camouflage measure is sought with which the generated infrared camouflage wall is as non-transparent as possible to the heat imaging devices of the enemy side, yet as transparent as possible on one's own side.

The above problems are solved according to the invention by improving the camouflage process of the aforementioned kind in such a manner that the camouflage wall is formed by discreetly distributed, large area particles, as compared to powdery or droplet shaped smoke substances. The said particles burn off at a temperature of over 600° C. and emit infrared rays. During the process the area size and distribution density of the particles for a specified ratio between the distance between the camouflage wall and the enemy object and the distance from the wall to the object to be protected are chosen in such a manner that the optical reproduction of the particles on the picture area constructed from pixels and belonging to the heat imaging device of both objects disturbs significantly more the heat image of the heat imaging device of the enemy object than that of the heating imaging device of the object to be protected.

At the same time it can be provided that the particles exhibit a radiating area ranging from 1 to 4 $cm^2$; and that the distribution density ranges from 10 to 30 particles per square meter of the camouflage wall area.

According to the invention, it can also be provided that the camouflage wall is generated at a distance of at least 30 meters from the object to be protected and the optics of the heat imaging device of the object to be protected are stopped down and focussed in such a manner that both the camouflage wall and the enemy object lie in the depth of focus range of the heat imaging device.

The invention also proposed that the camouflage wall is produced at a distance of at most 30 meters from the object to be protected and the optics of the heat imaging device of the object to be protected is stopped down and focussed in such a manner that the enemy object lies in and the camouflage wall lies far outside the depth of focus range of the optics of the heat imaging device.

Furthermore, the camouflage process according to the invention can be characterized by the fact that the heat image of the heat imaging device of the object to be protected is subjected to electronic processing, in particular digital image processing with relevant evaluation algorithms.

The camouflage particles according to the invention to implement the process according to the invention is characterized by the fact that it comprises a paper strip or segment of an area of one to 10 $cm^2$, preferably between 4 and 10 $cm^2$, and a combustion layer on the strip or segment, where the descent speed in air is set to less than 2 m/sec.

At the same time it can be provided that the combustion layer comprises 5 to 30% copper oxide, 5 to 20% magnesium powder, and the balance of red phosphorus.

BRIEF DESCRIPTION OF THE DRAWINGS

The invention is explained in detail with reference to the drawings in the following.

Figure 1:
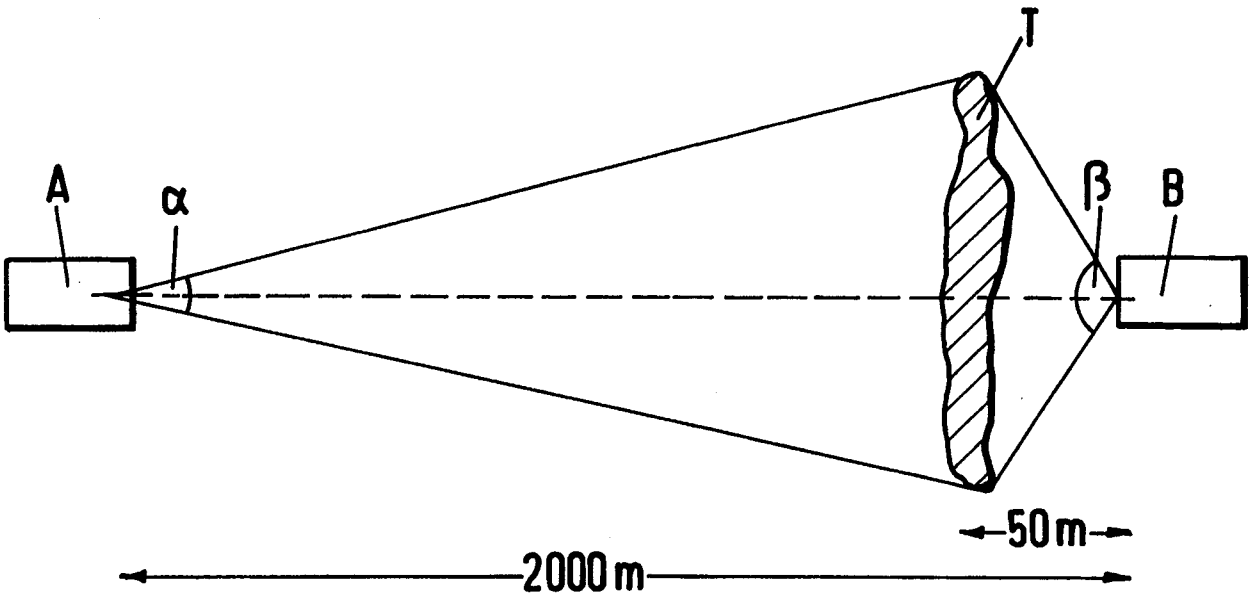
FIG. 1 is a sketch of a battle situation, as frequently occurs in practice.

If the tank B of FIG. 1 is located in the situation already described, and it attacked by a tank A 2,000 meters away, then tank B sets up a camouflage wall T, which is effective with respect to infrared radiation, at a distance of about 50 meters. For this camouflage wall comparatively large area particles of an infrared radiating area of, for example 1 $cm^2$, are used. The particles are discretely distributed in such a manner that the distribution density ranges from 10 to 30 particles per square meter of camouflage wall area. The camouflage wall can be produced by the known method, for example, by means of an ejection unit, which is located on tank B and shoots a projectile, which is filled with pyrotechnically active particles and whose central disperser load ejects the active bodies at a predetermined altitude above the ground and distributes the already ignited active particles. Typically, ejection is programmed after a flight of the projectile of about 50 m.

The projectile can be a cylindrical active substance container, which is 150 mm long and has a diameter of 76 mm. Suitable pyrotechnically active particles are phosphorous-coated paper strips or segments with a total area of about one to 10 $cm^2$, preferably 4 to 10 $cm^2$. By adding an oxidant, for example 5 to 30% copper oxide, and a metal powder, for example 5 to 20% magnesium powder, both the burning temperature and the burning speed are increased, during which process the temperature is supposed to be above 600° C. and the area that actually radiates during the entire burning operation is supposed to be about 1 $cm^2$. Instead of the phosphorous-coated paper strips, other active particles such as nitrocellulose strips or very coarsely pelletized pyrotechnical charges can also be used.

Figure 2A:
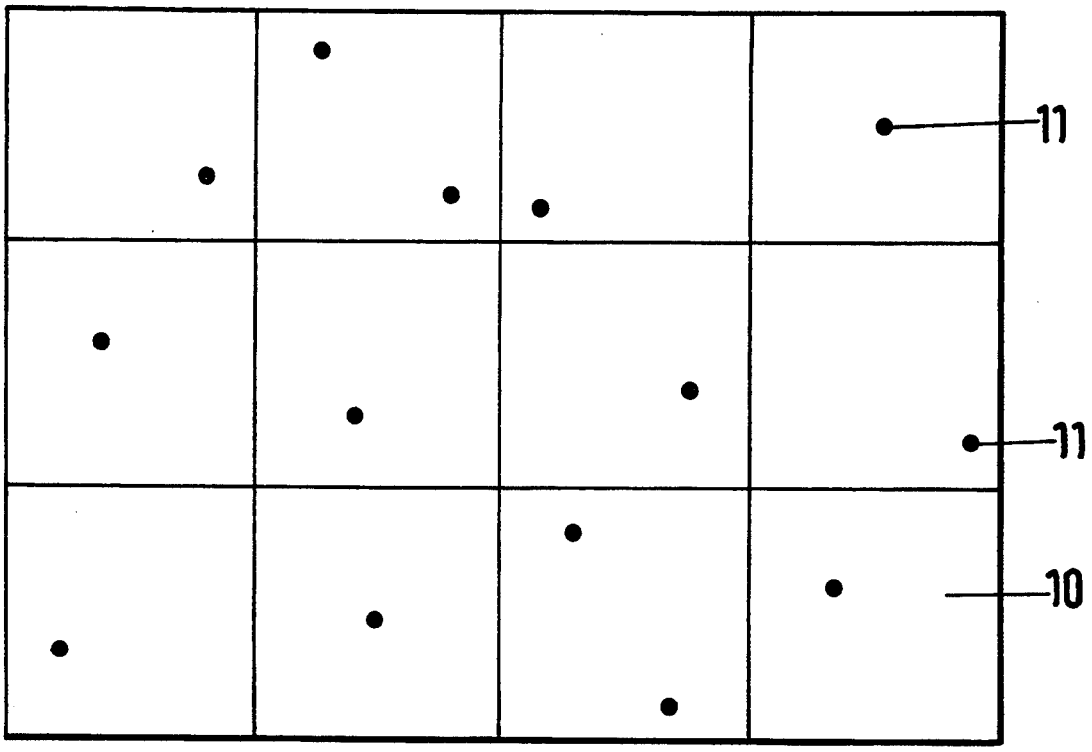
FIGS. 2A and 2B are drawings of reproductions of camouflage wall particles on the picture area of the heat imaging device of the enemy object (2A) and the object to be protected (2B)
Figure 2B:
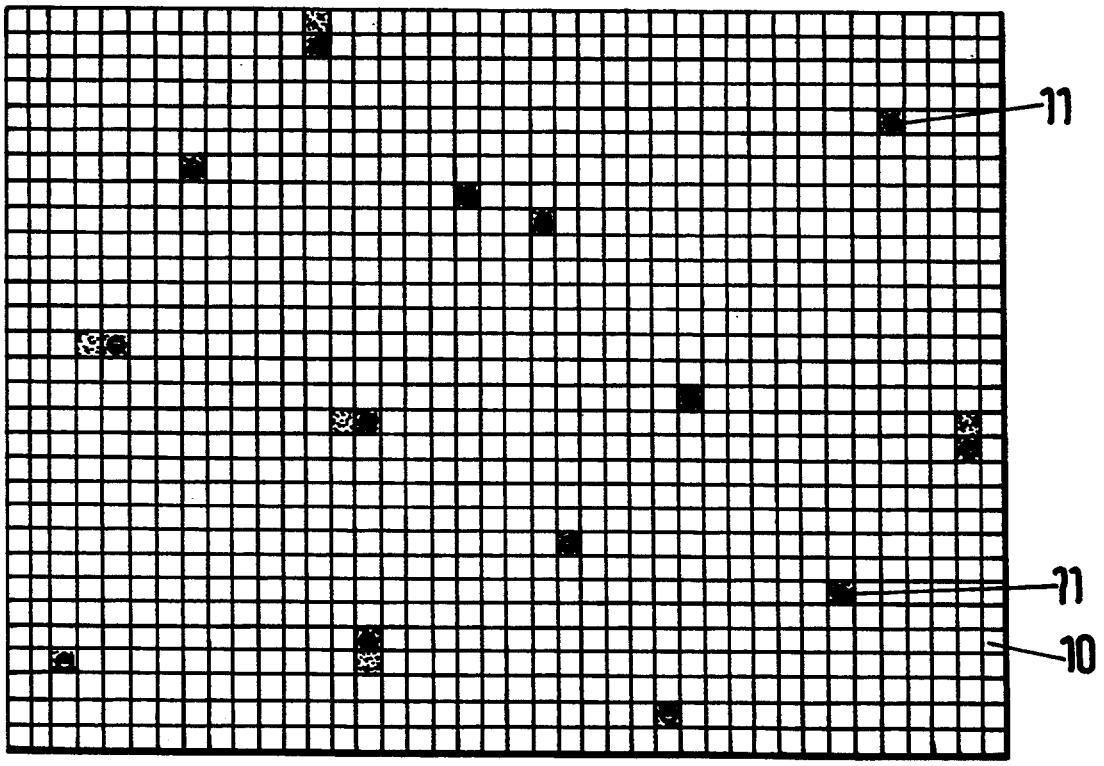

At this stage, how the camouflage wall and the hot particles forming the camouflage wall influence the heat imaging devices of both tanks A and B shall be explained with reference to FIG. 2A and 2B. In FIG. 2A the squares denoted as 10 are supposed to represent regions of the camouflage wall T, each of which is recorded by a pixel of the picture area of the heat imaging device of tank A. Owing to the great distance of 1,950 meters between camouflage wall and tank A, each pixel records a comparatively large surface region of the camouflage wall, for example, a region of at least 50×50 cm, with the consequence that each of these regions has at least one burning camouflage particle and thus a camouflage particle 11 emitting infrared rays. Thus, each pixel of the heat imaging device of tank A receives the infrared radiation of at least one camouflage particle, and this infrared radiation is so high at a particle temperature exceeding 600° C. that the pixel is "masked". Thus, the heat image of tank B located behind the camouflage wall T can no longer be recognized on the picture area of the heat imaging device of tank B, this situation being shown in FIG. 2B. Due to the short distance of only 50 meters between camouflage wall T and heat imaging device of tank B, each pixel records only one very small region of the camouflage wall area. For the example, distances of 1,950 m and 50 m are shown and the region recorded by a pixel of the heat imaging device of tank B is smaller by about the factor 40×40=1,600 than the region recorded by a pixel of the heat imaging device of tank A. This means, however, that only a small percentage of the pixels of the total picture area of the heat imaging device of tank B records a camouflage wall region with the radiating camouflage particle and is thus masked. These few "missing spots" do not significantly affect the heat image of the device, i.e., the heat imaging device of tank B can see through the camouflage wall T.

Figure 3A:
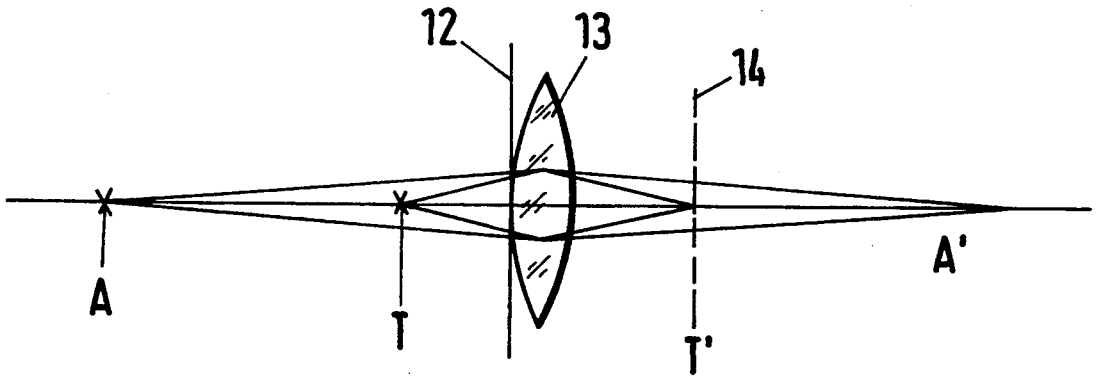
FIGS. 3A and 3B are sketches to explain two possible ways of adjusting the optics of the heat imaging device of the object to be protected.
Figure 3B:
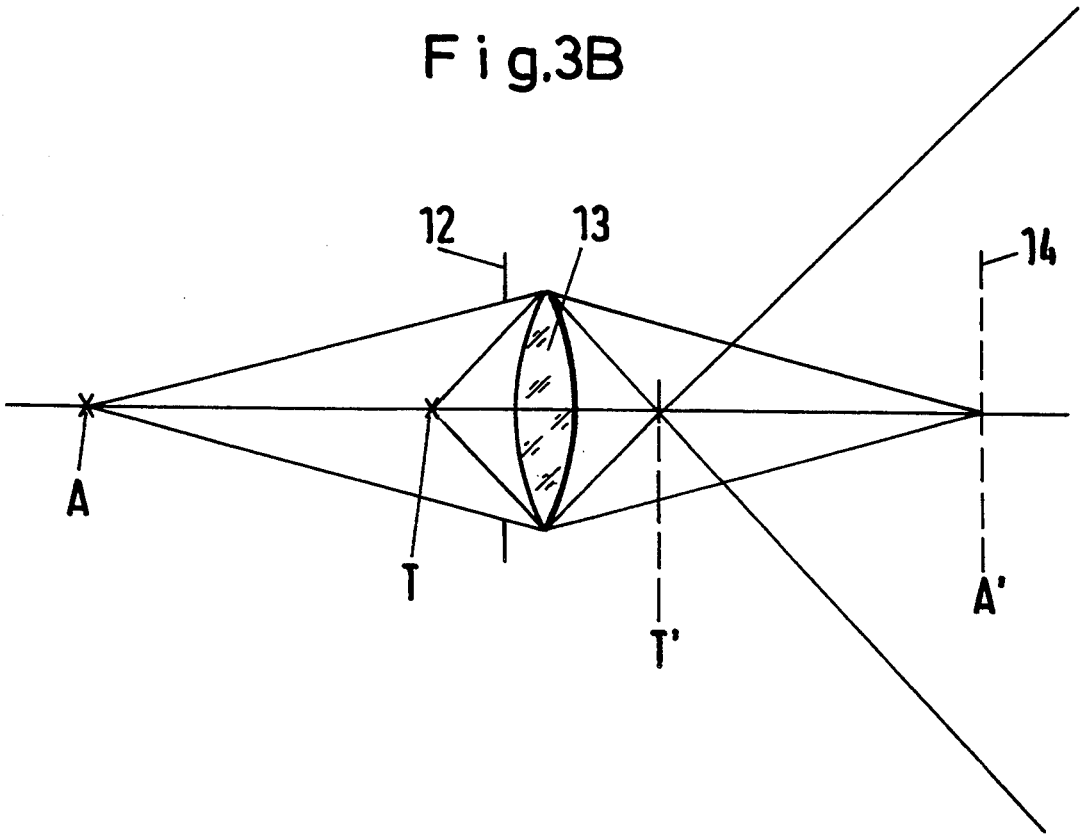

The crew of tank B has now the possibility of keeping the effect on the camouflage wall on its own heat imaging device as small as possible. The one possibility is to severely stop down the optics of the device, thus obtaining a high depth of focus, and to focus in such a manner that both tank A and the camouflage wall T lie in the depth of focus range. This state is clearly illustrated in FIG. 3, where the diaphragm is denoted as 12, the optics as 13, and the focal plane as 14, i.e., thus the focal plane of the heat imaging device of the tank B. Both tank A and the camouflage particles 11 are sharply reproduced on the focal plane 14. Specifically, the enemy tank A is clearly recognizable, and there are only a few distorted points on account of masked pixels (FIG. 2B). Another improvement of the heat image can be obtained through electronic measures, for example, through the use of digital image processing using suitable real time algorithms like median filtering, window blanking, correlation and the like. It is also possible to invert the signals emitted by the masked pixels, thus resulting in fewer disturbing black missing points, instead of white missing points, in the heat image.

The second of said two possibilities consists of opening as far as possible the diaphragm of the optics of the heat imaging device of tank B, with the consequence of a small depth of focus, and of focusing the optics on tank A. Thus, the heat image of tank A is sharply reproduced, whereas the camouflage particles are less defined and thus are significantly larger. In this manner noticeably more pixels of the device of tank B are "irradiated" by the camouflage particles, but the irradiation energy is extremely low as a consequence of the low definition. Thus, the heat image is altogether slightly "brightened" or covered with a slight grey veil without, however, covering the sharp reproduction of the enemy tank A. Here, too, a digital image evaluation can provide a contrast picture of tank A. This second possibility is preferred when the distance of tank B to camouflage wall T is very short, for example, under 30 meters, and to the enemy tank A very great, more than 2,000 meters. Thus, the optics of the device can no longer be severely stopped down that camouflage wall T and tank A fall into the depth of focus range.

Of course, the described embodiment can experience numerous modifications without abandoning the field of the invention. This applies especially to the design and distribution of the camouflage particles. Thus, for example, effective camouflage particles can also be blown by means of gas generators or issued by means of pyrotechnical spray mechanisms. Therefore, said paper strips coated with a combustion compound are advantageous because the exhibit they exhibit a comparatively low descent speed, for example, less than 2 m/sec. At higher descent speeds or with the demand for longer camouflage periods, the camouflage wall is to be maintained by shooting additional projectiles. Red phosphorous as the combustion material also offers additionally the advantage of forming smoke, thus producing a camouflage wall which also camouflages in the visible spectral range. Of course, it is also possible to house in the projectile containing the infrared camouflage particles conventional smoke charges for the visible spectral range and camouflage charges for the radar range, in order to obtain a combined camouflage effect. Finally, it should be also pointed out that the process of the invention can also be carried out with camouflage particles absorbing infrared rays, given that it is possible to distribute uniformly and discretely the absorbing particles exhibiting a size corresponding to the absorption area.

According to an embodiment of the invention, the absorbing or blocking particles have an average surface area of between one and ten $cm^2$. The particles may be distributed in a camouflage wall to have a distribution density of between 10 and 30 particles per square meter of wall area.

The wall of radiation absorbing or blocking particles may be formed by a first device at a distance from the first device that is about one tenth the distance between the first device and the second device. According to another embodiment, the wall is formed at a distance from the first device that is one twentieth the distance between the first device and the second device.

According to yet another embodiment of the invention, both the wall and the second device fall within the depth of focus range of the sensor of the first device. As an alternative, the wall can be formed outside the depth of focus range of the sensor of the first device, so long as the second device is within the depth of focus range of the sensor of the first device.

Although the present invention has been described in connection with preferred embodiments, it will be appreciated by those skilled in the art that additions, modifications, substitutions and deletions not specifically described may be made without departing from the spirit and scope of the invention defined in the appended claims.

What is claimed is:

1. A process to camouflage a first device which emits and detects infrared radiation, from a second device which emits and detects infrared radiation, while not camouflaging said second device from said first device, wherein each device has a sensor which detects infrared radiation and which has a depth of focus range and a picture area defined by a multiplicity of pixels arranged in a pattern, each pixel receiving infrared radiation from a specified region of an area being monitored and producing a signal which indicates detection of an infrared radiation emitting object upon receipt of infrared radiation, said process comprising the steps of:

forming a wall of particles at a location which intersects a straight line between said first and second devices wherein the distance between the first device and the wall is less than one tenth the distance between the wall and the second device, said wall comprising a distribution of said particles and having a known distribution density, said particles each emitting infrared radiation and each having a surface area of between about 1 and 10 $cm^2$ from which infrared radiation is emitted, wherein said surface area, said distribution density and a ratio of said distances are selected such that substantially each pixel of the sensor of said second device receives infrared radiation from at least one of said particles thereby masking substantially each pixel so that the heat image of the first device cannot be recognized on the picture area, and said surface area, said distribution density and said ratio of said distances are selected such that a sufficient number of pixels in the sensor of said first device receive infrared radiation from said second device without receiving infrared radiation from said particles to enable detection of the second device by the sensor of the first device.

2. A process to camouflage according to claim 1, wherein said particles have an average surface area of between one and four $cm^2$ from which infrared radiation is emitted.

3. A process to camouflage according to claim 1, wherein said distribution density is between 10 and 30 particles per square meter of wall area.

4. A process to camouflage according to claim 1, wherein said wall is formed at a distance of about one twentieth the distance between the first device and the second device.

5. A process to camouflage according to claim 1, wherein said particles comprise a combustible material that burns at a temperature exceeding 600° C., and said forming step includes igniting said particles.

6. A process to camouflage according to claim 1, wherein both said wall and said second device fall within the depth of focus range of the sensor of said first device.

7. A process to camouflage according to claim 1 wherein said wall is formed outside the depth of focus range of the sensor of said first device such that a low definition of infrared radiation from said wall is received, and the second device is within the depth of focus range of the sensor of said first device.

8. A process to camouflage a first device which emits and detects infrared radiation, from a second device which emits and detects infrared radiation, while not camouflaging said second device from said first device, wherein each device has a sensor which detects infrared radiation and which has a depth of focus range and a picture area defined by a multiplicity of pixels arranged in a pattern, each pixel receiving infrared radiation from a specified region of an area being monitored and producing a signal which indicates detection of an infrared radiation emitting object upon receipt of infrared radiation, said process comprising the steps of:

forming a wall of particles at a location which intersects a straight line between said first and second devices wherein the distance between the first device and the wall is less than one tenth the distance between the wall and the second device, said wall comprising a distribution of said particles and having a known distribution density, said particles each blocking infrared radiation and each having a surface area of between about 1 and 10 $cm^2$ from which infrared radiation is absorbed, wherein said surface area, said distribution density and a ratio of said distances are selected such that substantially all infrared radiation emitted from said first device in the direction of the sensor of said second device is blocked by said particles such that substantially each pixel of the sensor of said second device does not receive infrared radiation from said first device so that the heat image of the first device cannot be recognized on the picture area, and said surface area, said distribution density and said ratio of said distances are selected such that infrared radiation emitted from said second device is not blocked by said wall and a sufficient number of pixels in the sensor of said first device receive infrared radiation from said second device to enable detection of the second device by the sensor of the first device.

9. A process to camouflage according to claim 8, wherein said distribution density is between 10 and 30 particles per square meter of wall area.

10. A process to camouflage according to claim 8, wherein said wall is formed at a distance of about one twentieth the distance between the first device and the second device.

11. A process to camouflage according to claim 8, wherein both said wall and said second device fall within the depth of focus range of the sensor of said first device.

12. A process to camouflage according to claim 8, wherein said wall is formed outside the depth of focus range of the sensor of said first device, and the second device is within the depth of focus range of the sensor of said first device.

* * * * *